US010767243B2

(12) United States Patent
Barbosa

(10) Patent No.: US 10,767,243 B2
(45) Date of Patent: Sep. 8, 2020

(54) PURIFICATION PROCESS

(71) Applicant: Curium US LLC, Maryland Heights, MO (US)

(72) Inventor: Luis A. M. M. Barbosa, Alkmaar (NL)

(73) Assignee: Curium US LLC, St. Louis, MO (US)

( * ) Notice: Subject to any disclaimer, the term of this patent is extended or adjusted under 35 U.S.C. 154(b) by 280 days.

(21) Appl. No.: 15/826,280

(22) Filed: Nov. 29, 2017

(65) Prior Publication Data

US 2018/0142326 A1 May 24, 2018

Related U.S. Application Data

(62) Division of application No. 13/814,088, filed as application No. PCT/US2011/046176 on Aug. 2, 2011, now Pat. No. 9,856,543.

(30) Foreign Application Priority Data

Aug. 4, 2010 (GB) ..... 1013142.3

(51) Int. Cl.
*C22B 34/34* (2006.01)
*G21G 1/00* (2006.01)

(52) U.S. Cl.
CPC ..... *C22B 34/34* (2013.01); *G21G 1/001* (2013.01); *G21G 2001/0036* (2013.01)

(58) Field of Classification Search
CPC . C22B 34/34; G21G 1/001; G21G 2001/0036
See application file for complete search history.

(56) References Cited

U.S. PATENT DOCUMENTS 3,799,883 A 3/1974 Arino et al.
5,508,010 A * 4/1996 Sameh ..... C01G 39/003 423/2

(Continued)

FOREIGN PATENT DOCUMENTS

JP 10030027 2/1998
JP 2004150977 5/2004

(Continued)

OTHER PUBLICATIONS

Office Action dated Apr. 6, 2017 in related CA Application No. 2806584, 3 pages.

(Continued)

*Primary Examiner* — Jenny R Wu
(74) *Attorney, Agent, or Firm* — Polsinelli PC

(57) ABSTRACT

A process for purifying Mo-99 from an acidic solution obtained by dissolving an irradiated solid target comprising uranium in an acidic medium, or from an acidic solution comprising uranium and which has previously been irradiated in a nuclear reactor, or from an acidic solution comprising uranium and which has been used as reactor fuel in a homogeneous reactor, the process comprising contacting the acidic solution with an adsorbent comprising a zirconium oxide, zirconium hydroxide, zirconium alkoxide, zirconium halide and/or zirconium oxide halide, and eluting the Mo-99 from the adsorbent using a solution of a strong base, the eluate then being subjected to a subsequent purification process involving an alkaline-based Mo-99 chromatographic recovery step on an anion exchange material. Also provided is apparatus for carrying out the process.

4 Claims, 1 Drawing Sheet

(56) References Cited

U.S. PATENT DOCUMENTS

| | | | | |
|---|---|---|---|---|
| 5,681,974 | A | 10/1997 | Hasegawa et al. | |
| 5,774,782 | A * | 6/1998 | Mirzadeh ..... | A61K 51/1282<br>210/682 |
| 6,337,055 | B1 | 1/2002 | Betenekov et al. | |
| 2009/0225923 | A1* | 9/2009 | Neeley ..... | G21C 1/00<br>376/186 |

FOREIGN PATENT DOCUMENTS

| | | |
|---|---|---|
| KR | 20060017047 | 2/2006 |
| RU | 2288516 | 11/2006 |

OTHER PUBLICATIONS

Ali et al. "Production Techniques of Fission Molybdenum-99," Radiochimica Acta 41 65-72 (1987).

* cited by examiner

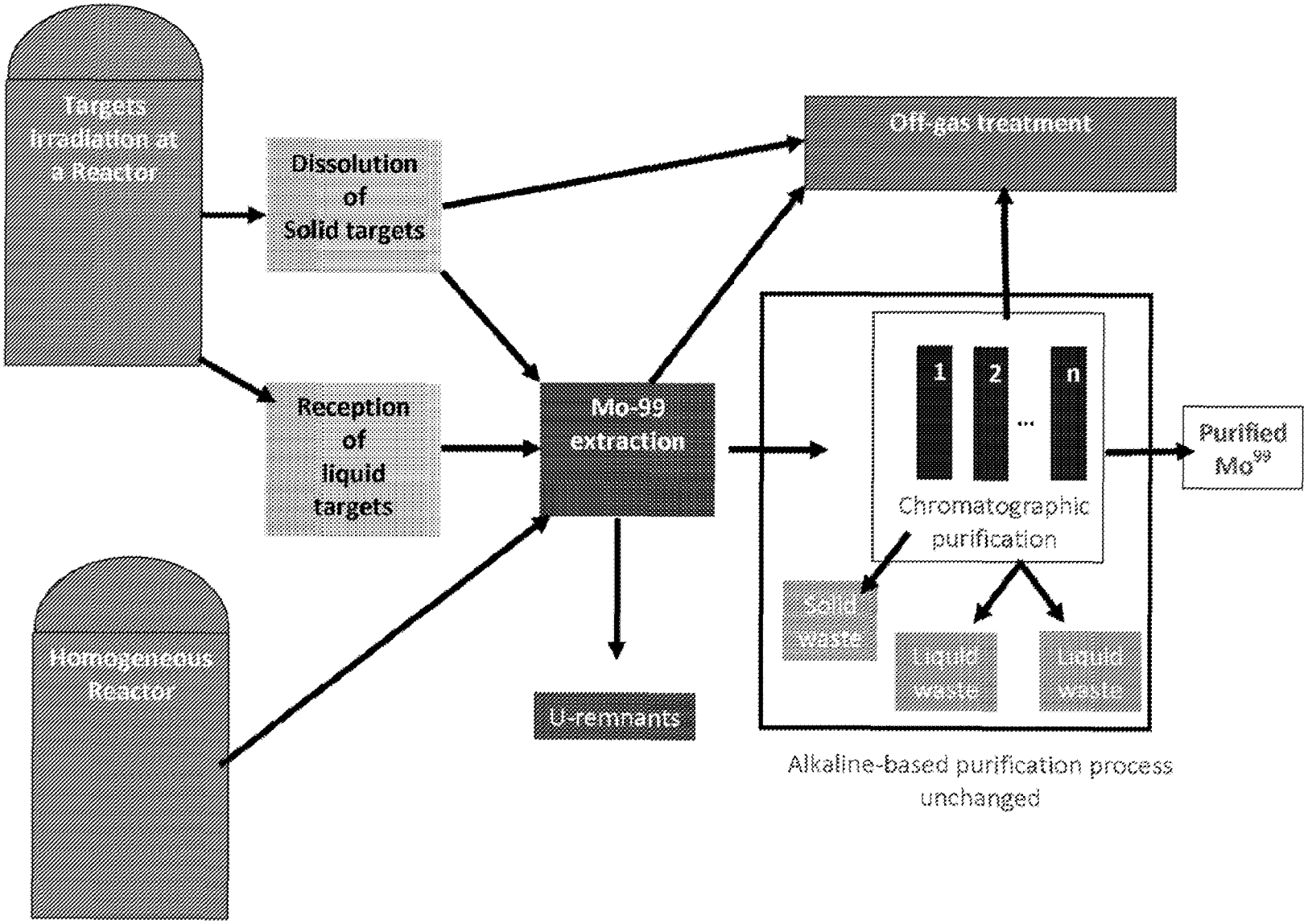
Targets irradiation at a reactor
Dissolution of Solid targets
Reception of liquid targets
Homogeneous Reactor
Off-gas treatment
Mo-99 extraction
U-remnants
1
2
...
n
Chromatographic purification
Solid waste
Liquid waste
Liquid waste
Purified $Mo^{99}$
Alkaline-based purification process unchanged

PURIFICATION PROCESS

This application is a divisional application of U.S. Ser. No. 13/814,088, filed Aug. 8, 2013, which is a national stage entry of PCT Application No. PCT/2011/046176, filed Aug. 2, 2011, which claims priority to GB 1013142.3 filed Aug. 4, 2010, each of which is hereby incorporated by reference in its entirety.

This invention relates to a purification process. In particular, although not exclusively, it relates to a process for purifying Mo-99 from other materials present following Mo-99 production from uranium in nuclear fission reactors.

Technetium-99m is the most widely used radiometal for medical diagnostic and therapeutic applications. Tc-99m is prepared by decay of Mo-99 in so-called Tc-99m generators. Such a generator typically comprises an aqueous solution of Mo-99 loaded onto an adsorbent (usually alumina). Following decay of the Mo-99 to Tc-99m, which has a lower affinity for the alumina, the Tc-99m may be eluted, typically using a saline solution. For the preparation of Tc-99m generators, a high purity source of Mo-99 is therefore essential.

In order to obtain Mo-99 of high specific activity, it is commonly prepared by the neutron-induced fission of a U-235 target. U-235 is typically present in a target form of U-metal foil, or tubular constructs of U and Al. Alternatively, the U may be in solution in an acidic medium (such as in liquid uranium targets, or as in the uranium solution used as fuel in a homogeneous reactor). The fission reaction leads to a proportion of the U-235 being converted to Mo-99, but also leads to a number of impurities in the reactor output. these impurities variously include Cs, Sr, Ru, Zr, Te, Ba, Al and alkaline and alkaline earth metals.

It is known to separate the desired Mo-99 from such impurities by dissolving the irradiated target in an alkaline medium, then subjecting it to a series of chromatographic separations on various adsorbents (A. A. Sameh and H. J Ache, Radiochim, Acta 41 65 (1987)). However, such a separation procedure has not been employed where the irradiated target is dissolved in an acidic medium, nor where the Mo-99 is present in the acidic medium of a liquid target or the fuel of a homogeneous reactor. Indeed, the process of Sameh and Ache comprises at least one step which is likely to be incompatible with an acid stream, the result of which is loss of a large proportion of the desired Mo-99. Whilst most known processes for Mo-99 production employ alkaline dissolution of the irradiated target, one particular process (employed at Chalk River Nuclear Laboratories by Atomic Energy of Canada Limited (AECL)) uses acid dissolution of tubular U—Al targets, followed by adsorption of the Mo-99 on alumina prior to subsequent purification steps. The problem with this method, however, is that the Mo-99 has a very high retention on the alumina, and hence losses occur when recovering the Mo-99 for subsequent purification. In addition, the alumina can leach chemical impurities into the Mo-99 eluate.

Another process involving acid dissolution of the irradiated target is the Modified Cintichem process (carried out in BATAN, Indonesia) developed at Argonne National Laboratory. This process, based on the Cintichem process, employs nitric acid dissolution of a U metal foil target. The Mo-99 is then precipitated with benzoin-alpha-oxime. After washing of the precipitate with nitric acid, it is dissolved in NaOH. The resulting solution is then passed through a silver coated charcoal column. It is believed that this process may not be suitable for use on a large Mo-99 production scale.

U.S. Pat. No. 6,337,055 describes a sorbent material for extraction of Mo-99 from a homogeneous reactor, the sorbent comprising hydrated titanium dioxide and zirconium hydroxide. The adsorbed Mo-99 is desorbed and eluted using a solution of a weak base (ammonia solution). A sorbent containing zirconium oxide, halide and alkoxide components is described in U.S. Pat. No. 5,681,974 for the preparation of Tc-99m generators. Similar adsorbents are described in JP 10030027, KR 20060017047 and JP 2004150977. In RU2288516, a Zr-containing adsorbent is used to adsorb Mo-99 from solutions of irradiated U-alloys in nitric acid, following which it is desorbed using NaOH or KOH. However, no subsequent purification of the Mo-99 is described.

In accordance with a first aspect of the present invention, there is provided a process for purifying Mo-99 from an acidic solution obtained by dissolving an irradiated solid target comprising uranium in an acidic medium, or from an acidic solution comprising uranium and which has previously been irradiated in a nuclear reactor, or from an acidic solution comprising uranium and which has been used as reactor fuel in a homogeneous reactor, the process comprising contacting the acidic solution with an adsorbent comprising a zirconium oxide, zirconium hydroxide, zirconium alkoxide, zirconium halide and/or zirconium oxide halide, and eluting the Mo-99 from the adsorbent using a solution of a strong base, the eluate then being subjected to a subsequent purification process involving an alkaline-based Mo-99 chromatographic recovery step on an anion exchange material.

In accordance with a second aspect of the present invention, there is provided a process for purifying Mo-99 from an acidic solution comprising uranium and which has previously been irradiated in a nuclear reactor, or from an acidic solution comprising uranium and which has been used as reactor fuel in a homogeneous reactor, or from an acidic solution obtained by dissolving an irradiated uranium metal foil solid target in an acidic medium, the process comprising contacting the acidic solution with an adsorbent comprising a zirconium oxide, zirconium hydroxide, zirconium alkoxide, zirconium halide and/or zirconium oxide halide, and eluting the Mo-99 from the adsorbent using a solution of a strong base.

In a preferred embodiment of the second aspect, the eluate is subsequently subjected to a purification process involving an alkaline-based Mo-99 chromatographic recovery step on an anion exchange material.

In the first and/or second aspects, the Mo-99 chromatographic recovery step may be carried out as the first step of the said subsequent purification process.

For the purposes of the present disclosure, the term 'strong base' is intended to signify a base having a $pK_b$ (calculated at 298K) of 4.5 or lower, such as 3.5 or lower, preferably 3.0 or lower, more preferably 2.0 or lower, or 1.0 or lower. Preferred bases include NaOH and KOH, particularly NaOH. Preferred concentrations of the solution of strong base may be from 0.1-5M, preferably 0.5-5M, more preferably 0.5-2.5M, most preferably 1-2M.

The term 'alkaline-based' as used herein is intended to signify that a step is carried out in a solution with pH greater than 7.0. Preferably, the pH of the solution for the alkaline-based Mo-99 chromatographic recovery step is 8 or more, 9 or more, 10 or more, 11 or more, 12 or more, or 13 or more.

During the acid dissolution of high or low enriched U-targets (dispersed or non-dispersed/U-metal foil), or after the irradiation of a high or a low enriched U-solution, or following use of U-solution as fuel in homogeneous reactors, U and other fission products are present together with the desired Mo-99 in the process stream. Mo-99 can be removed from this acid stream by using the above zirconium-containing sorbents. For example, the sorbents commercially available from Thermoxid Scientific & Production Co. (Zorechnyi, Russian Federation), marketed as Radsorb and Isosorb, and described in U.S. Pat. No. 6,337,055, may be used. Alternatively, one or more of the zirconium-containing sorbents described in U.S. Pat. No. 5,681,974, JP 10030027, KR 20060017047 and JP 2004150977 can be used. Following the adsorption step, Mo-99 can thereafter be eluted from the sorbent by using an appropriately concentrated solution of strong base (such as NaOH). This alkaline stream, which contains Mo-99 and certain other fission isotopes, can be then further purified using an alkaline-based separation process, e.g. using the steps described in the above-referenced document of Sameh and Ache.

In some embodiments, the adsorbent for use in the process of the invention also comprises a titanium oxide and/or silicon oxide. Such oxides provide the adsorbent material with improved mechanical and chemical properties. In particular, the mechanical and chemical resistance of the material in acidic solution is enhanced. Such materials also have improved radiation resistance. In particular embodiments, the zirconium compound is present at a concentration of from 5 to 70 mol % of the adsorbent composition. In such embodiments, the zirconium compound may in particular be present at 5 to 50, or 5 to 40 mol %.

In certain embodiments, the adsorbent is in the form of pellets. The pellets may suitably be of around 0.1 to 2 mm in size, so as to provide a balance between high adsorbent surface area, ease of flow of the Mo-99 solution through a vessel containing the sorbent, and suitably high mechanical strength. The specific surface area of the sorbent may be in the range 100 to 350 $m^2/g$.

In preferred embodiments, the reactor fuel solution (from a homogeneous reactor) is contacted with the adsorbent in a column packed with the adsorbent and provided with an inlet and an outlet. Such an arrangement allows the construction of a fluid circuit. Similarly this can be applied for the acid solution resulting from an acidic (e.g. $HNO_3$) digestion of U-solid targets, typically via a dissolver unit, or for the U-containing acid solution used as a conventional target at a nuclear reactor. The U/fission product solution is passed from the dissolver unit or a collecting vessel to the inlet of the adsorbent column. The non-adsorbed impurities can be eluted from the outlet in the acid stream and transferred to waste. The column can then be in fluid connection at its inlet to a source of strong base, which allows the elution of the Mo-99. The eluted Mo-99 in the strong basic solution is then subjected, according to the first aspect, and preferably according to the second aspect, to a purification process involving, preferably as a first step, an alkaline-based Mo-99 chromatographic recovery step on an anion exchange material. The process may also utilise further purification vessels (such as further ion exchange adsorbents) for additional purification of the Mo-99, for example using the above approach of Sameh and Ache.

In some embodiments, following passage of the fuel solution or acidic reactor product solution through the adsorbent-packed column, the column is flushed with a diluted acid solution (e.g. $HNO_3$ or $H_2SO_4$), depending on the original acid solution composition and/or rinsed with water.

Following elution of the Mo-99, the process of the first aspect (and preferably the process of the second aspect) includes the further step of contacting the Mo-99 eluate in the strong basic solution with an anion exchange material. As mentioned above, the process of the present invention provides the possibility of purifying an acid-based reactor product solution containing Mo-99 using an alkaline-based approach, e.g. that of Sameh and Ache. Once the solution of Mo-99 in strong base has been eluted from the zirconium-containing adsorbent, it may then be treated using an alkaline-based process. By contacting the Mo-99 strong basic solution with a suitable anion exchange material, the Mo-99 can be adsorbed, whilst cationic impurities (e.g. Cs, Sr, Ba) are not retained and can be washed away. A suitable anion exchange material is AG 1.times.8 (e.g. 200-400 mesh) or AG MPI (both available from Bio-Rad), on which the Mo-99 can be quantitatively adsorbed.

The anion exchange material may be washed with further strong base, e.g. NaOH. Thereafter, the Mo-99 may be at least partially eluted from the anion exchange material with a solution of acid (such as nitric acid, e.g. 3-4M).

Preferably, the eluted Mo-99 is thereafter brought into contact with a vessel (e.g. a column) containing $MnO_2$ material, which adsorbs Mo-99. This chromatographic column may then be subsequently rinsed with acidic solutions, e.g. $HNO_3/KNO_3$ and $K_2SO_4$. The $MnO_2$ material is then preferably dissolved with a highly concentrated solution of $H_2SO_4$ (9M) containing thiocyanide ions (e.g from ammonium thiocyanide) and a reducing agent (e.g. sodium sulphite and/or potassium iodide) in order to form the complex $[Mo(SCN)_6]^{3-}$. The solution containing this complex may subsequently be brought into contact with an ion exchange material comprising iminodiacetate groups. Ion exchange materials bearing these groups have a very high affinity for the Mo complex, whilst other fission products accompanying the Mo have a much lower affinity. A suitable ion exchange material for this step is Chelex-100 (e.g. 100-200 and/or 200-400 mesh). The ion exchange material having the adsorbed Mo complex may subsequently be washed with thiocyanide-containing sulphuric acid, sulphuric acid, then water. Thereafter, the Mo-99 may be eluted from the ion exchange material using a solution of a strong base, e.g. NaOH (e.g. 1M), preferably containing hydrogen peroxide $H_2O_2$. The purification step using the ion exchange material comprising iminodiacetate groups may be performed using two chromatographic columns, one loaded with Chelex-100 (100-200 mesh) and the other with Chelex-100 (200-400 mesh).

The eluted Mo-99 so obtained may subsequently be loaded into a vessel (e.g. a column) with a suitable anion exchange material, e.g. AG 1×4 (e.g. 200-400 mesh) (available from Bio-Rad), on which the Mo-99 can be quantitatively adsorbed. This column or columns is/are rinsed with water and $NH_4OH$ solution prior to elution with a concentrated solution of $HNO_3$. This purified Mo-99 solution may then be heated until dryness, subsequent to which the remaining solids may then be sublimated, for example at 800 deg C. The sublimated solids can thereafter be solubilised in an alkaline solution (e.g. $NH_4OH$, e.g. 4M). This solution is transferred to a flask, containing a solution of NaOH (around 1M) and $NaNO_3$ (around 5 M). The resulting solution is boiled to remove $NH_3$ and to adjust the final volume of the dispensing solution. The purified Mo-99 may then be loaded into an adsorbent (e.g. alumina)-containing vessel, in order to provide a Tc-99m generator.

In a further aspect, the present invention provides apparatus for carrying out the process of the first aspect, the apparatus comprising a column/vessel containing an adsorbent comprising a zirconium oxide, zirconium hydroxide, zirconium alkoxide, zirconium halide and/or zirconium oxide halide; a source of a solution of a strong base, the source of strong base solution being arranged in fluid communication with the column/vessel containing the adsorbent; and a vessel (e.g. a column) containing an anion exchange material and arranged in downstream fluid communication with the column/vessel containing the adsorbent.

The invention also provides a purified Mo-99 obtainable by the method of the first or second aspects. In a related aspect, there is also provided a solution of Mo-99 in strong base, the solution being obtainable by contacting (i) an acidic solution comprising uranium and which has previously been irradiated in a nuclear reactor, or (ii) an acidic uranium solution used as U-fuel in a homogeneous reactor, or (iii) an acidic solution obtained by dissolving an irradiated uranium metal foil solid target in an acidic medium, with an adsorbent comprising a zirconium oxide, zirconium hydroxide, zirconium alkoxide, zirconium halide and/or zirconium oxide halide, and eluting the Mo-99 from the adsorbent using a solution of a strong base.

In another aspect, the invention also provides the use of a strong base for the elution of Mo from an adsorbent comprising a zirconium oxide, zirconium hydroxide, zirconium alkoxide, zirconium halide and/or zirconium oxide halide, wherein the eluted Mo is subsequently purified using a process comprising at least one alkaline-based Mo-99 chromatographic recovery steps on an anion exchange material.

The invention will now be described in more detail by way of example only, and with reference to the appended FIG. 1, which shows a schematic diagram of one process of the invention.

The invention provides for the purification of an acid stream containing Mo-99 obtained directly from the dissolution of high enriched or low enriched U-targets (dispersed or non dispersed/U-metal foil) or from the irradiation of a high enriched or low enriched U-solution at nuclear reactors, or from a high enriched or low enriched U-solution used as fuel in a homogeneous reactor, by removing U and certain other fission products by using an alkaline-based process. The invention leads to a Mo-99 product with high purity, as might be found in the standard full alkaline based separation process, but opens the possibility of using such a separation process with acid-based output streams.

Thermoxid resins exhibit an extraordinarily strong affinity for molybdenum species in acid solutions in the presence of U, other fission products and nitrates or sulphates. Mo-99 is known to be eluted from this resin with ammonia solution (U.S. Pat. No. 6,337,055) with high purity. If this elution is instead performed with an appropriately concentrated solution of strong base, such as NaOH (for example, 1-2 M), this stream can be further purified by employing some or all separation steps of an alkaline-based process, e.g. that described in the above-referenced disclosure of Sameh and Ache. The present invention is based on an unexplored manner to combine two different processes: i) the first purification step of a stream originating directly from an acid dissolution of high or low enriched U-targets (dispersed or non-dispersed/U-metal foil) or after the irradiation of a high or a low enriched U-solution in a nuclear reactor or from a high or low enriched U-acid solution used as fuel in a homogeneous reactor; with ii) the complete scheme of an alkaline based purification process.

Suitable adsorbents for use according to the invention include Isosorb (Thermoxid-5M, T-5M or T-5) and Radsorb (Thermoxid-52M, T-52M or T-52), both available from Thermoxid Scientific & Production Co.

EXAMPLE 1

U (Low Enriched Uranium)-Foil Process

A quantity of U-metal foil is dissolved in an appropriate solution of nitric acid, as described in chemical equation (1), in order to produce a final uranium concentration of 150 g/L and a final pH of the solution equal to 1.

$$U_{metal}+4HNO_3 \rightarrow UO_2(NO_3)_2+2H_2O+2NO_{(g)} \quad [1]$$

The final solution, which contains Mo-99 among other isotopes, is conducted through a column containing one of the Zr-containing sorbents, for instance Termoxid T52 (see FIG. 1—'Mo-99 extraction'). With an appropriate flow the loading of this column may take around 30 to 60 minutes. After the loading procedure, Mo-99 is retained in the column together with traces of U and other fission products. The column is then washed with a solution of 0.1M $HNO_3$ with a volume corresponding to eight column bed volumes. This washes out almost all U retained in the column. The Mo-99 elution can be done using a solution of NaOH (1M), preferably using a maximum of three column bed volumes. This solution is then further purified using the AG 1.times.8 sorbent, as described by Sameh and Ache.

EXAMPLE 2

Homogeneous Reactor

Following the teachings of U.S. Pat. No. 5,596,611, a uranyl nitrate ($UO_2(NO_3)_2$) solution follows the same procedure as described in Example 1. Since the homogeneous reactor solution is typically much larger than the one obtained by dissolving U-metal foil targets, the solution flow speed should be adjusted to maintain the total loading time. Both rising and elution steps are equivalent for both methods.

All documents cited above are hereby incorporated herein by reference in their entirety.

The invention claimed is:

1. An apparatus for carrying out a process for purifying Mo-99, the apparatus comprising:

- a column or vessel containing an adsorbent comprising a zirconium oxide, zirconium hydroxide, zirconium alkoxide, zirconium halide and/or zirconium oxide halide; a source of a solution of a strong base, the source of strong base solution being arranged in fluid communication at an inlet of the column or vessel containing the adsorbent;
- a column or vessel containing an anion exchange material on which Mo-99 can be quantitatively adsorbed and arranged in downstream fluid communication with the column or vessel containing the adsorbent;
- a source of a solution of an acid, the source of acid solution being arranged in fluid communication at an inlet of the column or vessel containing the anion exchange material; and
- a column or vessel containing $MnO_2$ material and arranged in downstream fluid communication with the column or vessel containing the anion exchange material;
- a source of a solution of sulfuric acid containing thiocyanide ions and a reducing agent, the source of sulfuric acid solution containing thiocyanide ions and a reducing agent being arranged in fluid communication at an inlet of the column or vessel containing the $MnO_2$ material;

and a column or vessel containing an ion exchange material comprising iminodiacetate groups and arranged in downstream fluid communication with the column or vessel containing the $MnO_2$ material.

2. An apparatus of claim 1, wherein the adsorbent further comprises a titanium oxide and/or silicon oxide.

3. An apparatus of claim 1, wherein the zirconium compound is present at a concentration of from 5 to 70 mol % of the adsorbent.

4. An apparatus of claim 1, wherein the adsorbent is in the form of pellets.

* * * * *